United States Patent [19]

Bosniack et al.

[11] 4,110,196

[45] Aug. 29, 1978

[54] CONVERSION OF SULFONIC ACIDS INTO A HYDROCARBON OIL OF SUPERIOR OXIDATION STABILITY

[75] Inventors: David S. Bosniack; Paul F. Korbach, both of Baytown, Tex.

[73] Assignee: Exxon Research & Engineering Co., Linden, N.J.

[21] Appl. No.: 749,595

[22] Filed: Dec. 10, 1976

[51] Int. Cl.[2] ..... C10G 23/00

[52] U.S. Cl. ..... 208/13; 208/14; 260/668 R

[58] Field of Search ..... 208/13, 14; 260/668 R

[56] References Cited

U.S. PATENT DOCUMENTS

| | | | |
|---|---|---|---|
| 2,028,185 | 1/1936 | Bird | 208/13 |
| 2,036,973 | 4/1936 | Sullivan | 208/13 |
| 2,768,130 | 10/1977 | White | 208/13 |
| 3,149,063 | 9/1964 | Brunel | 208/13 |

OTHER PUBLICATIONS

Gilbert, "Sulfonation and Related Reactions", (1965) pp. 429 to 432.

*Primary Examiner*—Herbert Levine
*Attorney, Agent, or Firm*—Yale S. Finkle

[57] ABSTRACT

Sulfonic acids are converted into a hydrocarbon oil of superior oxidation stability by transforming the acids into compounds selected from the group consisting of ammonium sulfonates, substituted ammonium sulfonates, and sulfonic acid esters; and hydrotreating the resultant sulfonic acid derivatives at elevated temperatures in the presence of a hydrotreating catalyst. The hydrotreating process frees the parent hydrocarbons that originally constituted the organic portion of the sulfonic acids by cleaving the carbon-sulfur bond of the sulfonic acid derivatives. These parent hydrocarbons are recovered from the reaction products of the hydrotreating step and comprise a hydrocarbon oil that exhibits a higher stability toward oxidation than can otherwise be obtained from other hydrocarbon oils of similar composition and viscosity.

8 Claims, 2 Drawing Figures

FIG. 1.
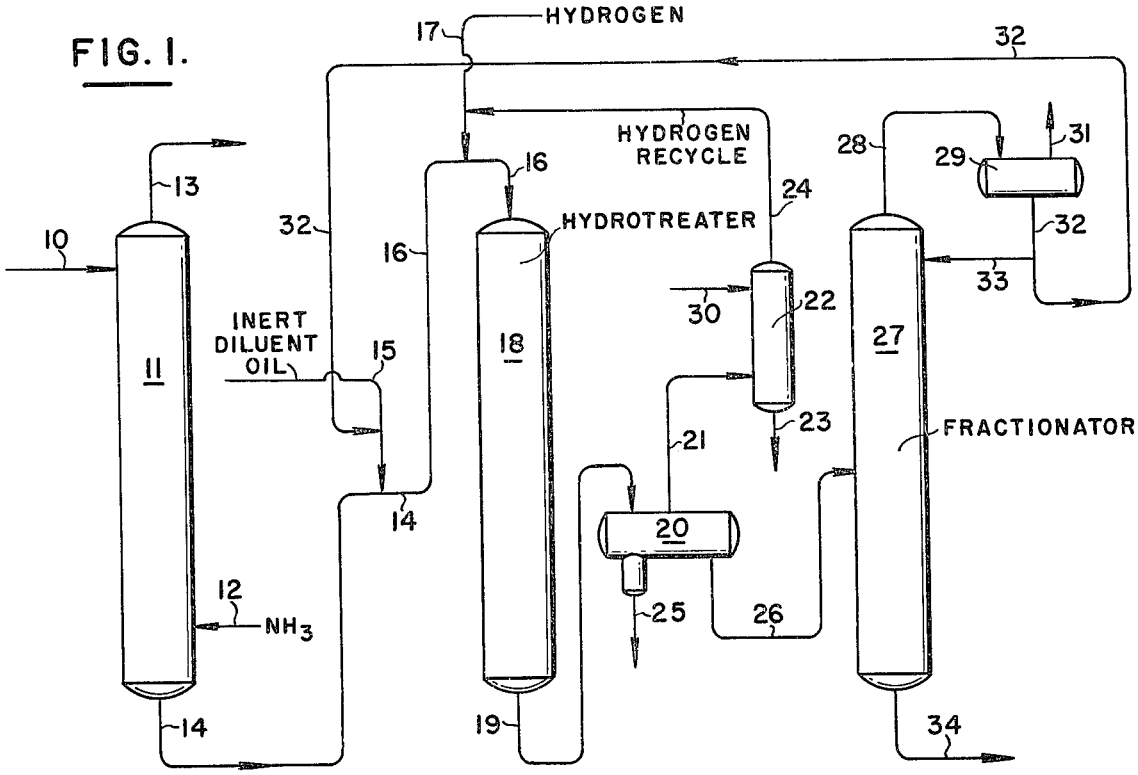
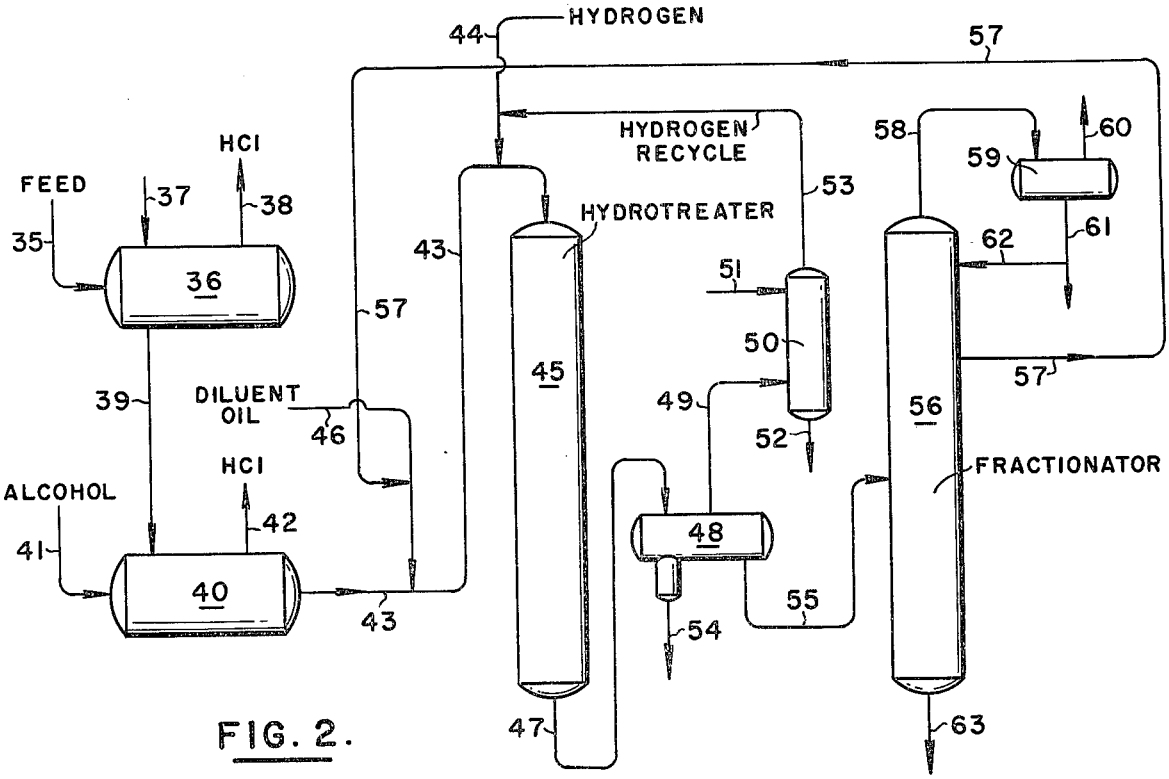
FIG. 2.

CONVERSION OF SULFONIC ACIDS INTO A HYDROCARBON OIL OF SUPERIOR OXIDATION STABILITY

BACKGROUND OF THE INVENTION

1. Field of the Invention

This invention relates to the processing of sulfonic acids and is particularly concerned with converting such acids into a hydrocarbon oil of superior oxidation stability.

2. Description of the Prior Art

Petroleum fractions produced by physical separation and catalytic conversion of the components of crude oil contain appreciable quantities of undesirable impurities such as sulfur-containing compounds, olefins, oxygen-containing compounds, nitrogen-containing compounds and the like. These impurities affect the color, odor, stability and corrosive properties of the particular hydrocarbon oil in which they reside. One conventional method of removing some of these impurities is acid treating, the treatment of a petroleum fraction with sulfuric acid, oleum or sulfur trioxide. The action of these acid treating agents may be multiple. These agents may, for example, extract, sulfonate, sulfate, oxidize and polymerize, depending on the impurities present in the hydrocarbon oil undergoing treatment. Acid treatment will normally remove at least a portion of the sulfur and asphaltic or gum-like materials, improve color and stability, and to some extent improve the odor.

A frequent product of acid treatment is petroleum sulfonic acids produced by the sulfonation of hydrocarbons in the petroleum fraction treated by the sulfuric acid, oleum or sulfur trioxide. Aromatic hydrocarbons are easily sulfonated compared to saturated hydrocarbons of the paraffin and cycloparaffin series. Sulfonic acids are normally recovered from the acid treating process in the form of salts or petroleum sulfonates. Oil soluble petroleum sulfonates have wide industrial application as surface-active agents and are used as emulsifiers, dispersants, wetting agents and rust and corrosion inhibitors. These sulfonates are primary ingredients in such products as soluble cutting oils, textile oils, and rust preventatives.

A large quantity of petroleum sulfonates is produced as a by-product during the manufacture of technical and medicinal grade white oils. The feed to the white oil production process is normally some type of hydrocarbon base oil containing saturated aliphatic and naphthenic compounds unreactive to conventional acid treating agents, and aromatic compounds of all types; including one, two and three ring structures that may contain olefinic linkages and highly reactive appendages such as oxygen, nitrogen, sulfur and the like. The feed stock is treated with sulfuric acid, oleum or sulfur trioxide, which converts the highly reactive aromatics into sulfonic acids while having little effect on the unreactive saturated aliphatic and naphthenic compounds. After acid treatment, the acid sludge is separated from the oil phase and disposed of. The oil phase, which contains the oil soluble sulfonic acids, is neutralized and mixed with a solvent such as isopropanol or the like. The sulfonates produced when the oil-soluble sulfonic acids are neutralized dissolve in the solvent, which is then separated from the oil phase. The remaining hydrocarbons are known as white oils because of their purity, non-reactivity and absence of color. The separated solvent solution is normally mixed with an inert diluent oil and the mixture is heated to remove the solvent. The remaining product will normally contain between about 45 and 65 weight percent sulfonates and is normally sold in this form as natural petroleum sulfonates. These sulfonates are in actuality a diluted mixture of many diverse types of aromatic sulfonates.

In the past there have been periods of time when the demand for petroleum sulfonates was low and was far exceeded by the amount of sulfonic acids produced during acid treatment. If such a situation should arise again, it may be desirable to dispose of the sulfonic acids economically and in an ecologically acceptable manner without converting them to petroleum sulfonates, which may be difficult to sell because of low demand.

SUMMARY OF THE INVENTION

This invention provides a process for converting sulfonic acids into a useful hydrocarbon product. In accordance with the invention, it has now been found that sulfonic acids can be converted into a hydrocarbon oil of superior oxidation stability by transforming the sulfonic acids into compounds selected from the group consisting of ammonium sulfonates, substituted ammonium sulfonates, and sulfonic acid esters; and hydrotreating the resultant sulfonic acid derivatives in the presence of a hydrotreating catalyst. The hydrotreating process frees the parent hydrocarbons that originally constituted the organic portion of the sulfonic acids by cleaving the carbon-sulfur bond of the sulfonic acid derivatives. These parent hydrocarbons are recovered from the reaction products of the hydrotreating step and comprise a hydrocarbon oil product that possesses an oxidation stability substantially greater than other hydrocarbon oils of comparable composition and viscosity and therefore will normally exhibit a longer service life than such oils when used as or as a component of motor oils, transformer oils, cutting oils, quench oils, process oils and the like.

The sulfonic acids are transformed into ammonium sulfonates or substituted ammonium sulfonates by reacting the acids with ammonia or a substituted ammonia compound such as ammonium hydroxide, methylamine, ethylamine or the like. The acids are transformed into sulfonic acid esters by reacting them with a compound, such as thionyl chloride, that will transform the acids into their corresponding hydrocarbon sulfonyl chlorides. The sulfonyl chlorides are then reacted with an alcohol to form the desired sulfonic acid esters. Alternatively, the sulfonic acid esters may be prepared by heating the sulfonic acids with a trialkyl phosphate. Before the sulfonic acid derivatives are subjected to hydrotreating, it may be desirable to decrease their viscosity by mixing them with an inert diluent oil.

The process of this invention provides an economical and ecologically acceptable procedure for converting sulfonic acids into a useful and desirable hydrocarbon product that has properties superior to oils of similar composition and viscosity prepared in conventional ways.

BRIEF DESCRIPTION OF THE DRAWINGS

FIG. 1 is a schematic flow diagram of one embodiment of a process for converting sulfonic acids into a hydrocarbon oil of superior oxidation stability by first transforming the sulfonic acids into ammonium sulfonates and thereafter hydrotreating the sulfonates.

FIG. 2 is a schematic flow diagram of a second embodiment of a process for converting sulfonic acids into a hydrocarbon oil of superior oxidation stability by first transforming the sulfonic acids into sulfonic acid esters and thereafter hydrotreating the esters.

DESCRIPTION OF THE PREFERRED EMBODIMENTS

In the process depicted in FIG. 1, a feed stream containing sulfonic acids that are to be converted into a hydrocarbon oil of superior oxidation stability is introduced through line 10 into the contacting zone in reactor or similar contacting vessel 11. The feed stream will normally contain a mixture of differing types of sulfonic acids recovered as by-products in the acid treating of various petroleum fractions produced during the refining of crude oil. The feed, however, may be a pure sulfonic acid and need not necessarily be derived from the refining process. The feed may be composed entirely of sulfonic acids or may contain the acids in combination with other organic or inorganic compounds. Preferably, the feed stream will be a mixture of oil soluble, aromatic sulfonic acids produced during the manufacture of medicinal or technical grade white oils.

The feed stream is introduced into the top of contacting vessel 11 and moves downwardly through the contacting zone where it comes in contact with an upflowing stream of gaseous ammonia introduced into the bottom of the vessel through line 12. If desired, the contacting zone may be provided with spray nozzles, perforated plates, bubble cap plates, packing or other means for promoting intimate contact between the gas and liquid. As the sulfonic acids in the feed stream pass downwardly through the contacting zone, they are neutralized by the rising ammonia and transformed into ammonium sulfonates. The amount of ammonia injected into vessel 11 will normally be slightly in excess of that needed to neutralize all of the sulfonic acids. Any excess ammonia is removed overhead from the vessel through line 13 and may be recovered for reuse or transferred to downstream units for further processing. A bottoms stream containing the ammonium sulfonates produced in the contacting zone is removed from vessel 11 through line 14.

The purpose of the above-described neutralization step is to transform the sulfonic acids into compounds that are susceptible to hydrotreating. Studies indicate that sulfonic acids themselves cannot be effectively hydrotreated because they tend to weaken the structural support of the hydrotreating catalyst, which in turn results in the production of fines that contaminate the hydrotreated product. This observed catalyst deterioration makes any proposed commercial process that includes the direct hydrotreating of sulfonic acids unfeasible. Studies further indicate that sodium sulfonates and similar metallic salts of sulfonic acids cannot be effectively hydrotreated. These metallic sulfonates appear stable in the presence of hydrogen, conventional hydrotreating catalysts and standard hydrotreating conditions and therefore will not yield the desired hydrocarbon oil product.

It has been found that ammonium sulfonates, substituted ammonium sulfonates such as methyl ammonium sulfonate, methyl ethyl ammonium sulfonate, dimethyl ammonium sulfonate and the like, and sulfonic acid esters will undergo hydrotreating. Apparently, the hydrotreating process cleaves the carbon-sulfur bond of these sulfonates and esters and thereby results in the production of the parent hydrocarbons that originally constituted the organic portion of the sulfonic acids. It has been found that these parent hydrocarbons comprise a hydrocarbon oil that exhibits a higher stability toward oxidation than can otherwise be obtained from other hydrocarbon oils of similar composition and viscosity. A process for producing a hydrocarbon oil of high oxidation stability by first transforming the sulfonic acids to sulfonic acid esters is shown in FIG. 2 and discussed in detail hereafter.

In the process depicted in FIG. 1, the sulfonic acids in the feed to vessel 11 are transformed into ammonium sulfonates by reacting them with gaseous ammonia. It will be understood that the sulfonic acids may be reacted with any nitrogen-containing compound or mixture of such compounds that will transform the acids into ammonium sulfonates or substituted ammonium sulfonates. Such a nitrogen-containing compound will have the generalized formula:

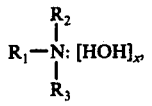

where $x$ is 0 or 1 and $R_1$, $R_2$, and $R_3$ may be the same or different and may be, for example, (1) hydrogen atoms; (2) straight or branched chain aliphatic groups or substituted aliphatic groups having from 1 to about 16 carbon atoms, such as methyl, ethyl, 1-propyl, 2-propyl, butyl, hexyl, heptyl, benzyl, octyl, decyl, and 1,1-dimethyldodecyl radicals; (3) cycloaliphatic groups having from 3 to about 10 carbon atoms such as cyclopropyl, cyclopentyl, cyclohexyl, methylcyclohexyl and perhydronaphthyl radicals; and (4) aryl groups having from 6 to about 12 carbon atoms, such as phenyl, tolyl, biphenyl, and butylbenzene radicals.

Specific examples of nitrogen compounds or mixtures of such compounds that may be used are ammonia and substituted ammonia compounds such as ammonium hydroxide, methylamine, dimethylamine, trimethylamine, ethylamine, butylamine, hexylamine, cyclohexylamine, benzylamine, octylamine, decylamine, N—butyl—N—phenylamine, a mixed branched chain isomeric, 1,1-dimethyl $C_{12}$–$C_{14}$ primary aliphatic amine composition sold under the tradename PRIMENE 81-R, and the like. The ammonia and substituted ammonia compounds will add to the hydrogen atom of the sulfonic acids to form the corresponding ammonium sulfonates or substituted ammonium sulfonates, which are subsequently subjected to hydrotreating.

Before the neutralization step effluent containing the ammonium sulfonates or substituted ammonium sulfonates is subjected to hydrotreating, it may be advantageous to mix the effluent with an inert diluent oil. One example of a situation in which a diluent oil should normally be used is when the effluent is so viscous that it cannot be easily pumped and may cause plugging of the catalyst bed in the hydrotreater. The inert diluent oil will normally be a saturated hydrocarbon or a mixture of saturated hydrocarbons such as pentane, hexane, heptane, octane, isooctane or higher molecular weight hydrocarbons. An aromatic compound or mixture of aromatic compounds may, however, be used as the diluent oil if it is inert to the sulfonates and the hydrotreating process. If a diluent oil is used, a sufficient amount is normally mixed with the sulfonates-containing stream to produce a solution that is composed of from about 20 to about 80 volume percent diluent oil. In some cases it may be advantageous to add the diluent oil before the stream containing the sulfonic acids is neutralized, especially in situations where the feed is viscous and difficult to pump.

Referring again to the process depicted in FIG. 1, the bottoms stream from vessel 11, which contains ammonium sulfonates, is passed through line 14 into line 16 where it is mixed with hydrogen gas injected into line 16 via line 17. If desired, the bottoms may first be mixed with an inert diluent oil injected through line 15 into line 14. The mixture of diluent oil, bottoms and hydrogen gas is then passed into hydrotreater 18. The hydrotreater contains a fixed bed of standard hydrotreating catalyst in the form of extrudate or pills. The catalyst will normally be composed of nickel-cobalt-molybdenum, nickel-molybdenum, cobalt-molybdenum or similar catalytically active compounds supported on inert silica-alumina. The mixture of diluent oil, sulfonates-containing bottoms and hydrogen is passed downward through the catalyst bed under standard hydrotreating conditions, conditions that are described in the literature and will therefore be familiar to those skilled in the art. In the presence of the hydrotreating catalyst, the hydrogen reacts with the ammonium sulfonates to cleave their carbon-sulfur bonds and produce sulfonic acid parent hydrocarbons, ammonia, hydrogen sulfide and water.

The hydrotreater effluent containing, among other substances, sulfonic acid parent hydrocarbons, diluent oil, ammonia, hydrogen sulfide, unreacted hydrogen and water is withdrawn from the hydrotreater through line 19, cooled and passed to separator or similar vessel 20 where the gases in the hydrotreater effluent are allowed to separate from the liquids and are withdrawn through line 21 and passed to scrubber or similar device 22. Here unreacted hydrogen is separated from the other gases, primarily ammonia and hydrogen sulfide, by passing the mixture of gases upward through a downflowing scrubbing liquid injected into the top of the scrubber via line 30. The scrubbing liquid absorbs the ammonia and hydrogen sulfide and is withdrawn from the bottom of the scrubber through line 23 and passed to downstream units for regeneration or further processing. Any solvent, including water, that will selectively absorb hydrogen sulfide and ammonia in the presence of hydrogen may be used as the scrubbing fluid. Such solvents are described in the literature and will be familiar to those skilled in the art. The hydrogen is withdrawn from the scrubber through line 24 and recycled to the hydrotreater via lines 17 and 16.

The water in separator 20 will normally have a greater specific gravity than the oil phase and is removed via line 25 and passed to downstream units for further processing. The oil phase, which consists of, among othersubstances, the sulfonic acid parent hydrocarbons formed during hydrotreating and diluent oil, is withdrawn from the separator through line 26 and fed to fractionator 27 where the parent hydrocarbons are separated from the diluent oil and other components. The diluent oil will normally have a boiling point lower than the initial boiling point of the parent hydrocarbons and therefore will normally be removed from the top of the fractionator through line 28 along with gases and other lower boiling constituents. The fractionator overhead is cooled and passed to distillate drum 29 where the gases are taken off overhead through line 31 and passed to downstream units for further processing. The liquid, which will normally be pure diluent oil, is withdrawn from distillate drum 29 through line 32. A portion of this liquid may be returned as reflux to the upper portion of the fractionator through line 33. The remaining liquid may be recovered or recycled to the process via line 15.

The parent hydrocarbons are removed in liquid form from the bottom of fractionator 27 via line 34 and recovered as the hydrocarbon oil product. Studies indicate that this hydrocarbon oil product possesses an oxidation stability substantially greater than other hydrocarbon oils of comparable composition and viscosity, which are prepared in other ways. This superior oxidation stability makes the hydrocarbon oil product an excellent base stock for blending with other oils to form hydrocarbon mixtures that normally exhibit longer than normal service lives when used as transformer oils, motor oils, heat transfer oils, cutting oils, quench oils, stain resistant rubber extender oils, cable oils, plasticizers and the like.

FIG. 2 in the drawing illustrates an alternative embodiment of the process of the invention in which the sulfonic acids are first transformed into sulfonic acid esters, which are thereafter hydrotreated to produce a high stability hydrocarbon oil. In this embodiment the feed stream containing the sulfonic acids is passed through line 35 into mixing tank or similar vessel 36 where the stream is mixed with thionyl chloride injected into the tank via line 37. The thionyl chloride reacts with the sulfonic acids in the feed stream to produce the corresponding hydrocarbon sulfonyl chlorides, gaseous hydrogen chloride and gaseous sulfur dioxide. The gases are removed via line 38 and passed to downstream units for further processing. The purpose of the above-described step of the process is to convert the sulfonic acids into their corresponding hydrocarbon sulfonyl chlorides. It will be understood that compounds other than thionyl chloride may react with sulfonic acids to form hydrocarbon sulfonyl chlorides and therefore may be used in lieu of the sulfonyl chlorides. Suitable compounds may be phosphorous pentachloride, phosphorous oxychloride and the like.

The hydrocarbon sulfonyl chlorides formed in tank 36 are withdrawn via line 39 and passed to mixing tank or similar vessel 40 where they are converted into sulfonic acid esters by reaction with an alcohol injected into the tank via line 41. Any alcohol may be used, however, a low molecular weight, saturated alcohol such as methanol, ethanol, propanol, butanol, pentanol or the like is generally preferred. Hydrogen chloride gas, which is generated during the reaction between the alcohol and the sulfonyl chlorides, is removed from tank 40 via line 42 and passed to downstream units for further processing.

The above-described portion of the process depicted in FIG. 2 consists of a two-step method for transforming sulfonic acids into sulfonic acid esters. It will be understood that for purposes of the invention any method that will transform sulfonic acids into their corresponding esters may be used. An example of such a method is the reaction of the sulfonic acids directly with a trialkyl phosphate to produce the corresponding sulfonic acid esters in a one step procedure.

Referring again to FIG. 2, the mixture of liquid sulfonic acid esters formed in tank 40 is withdrawn through line 43, mixed with hydrogen gas injected into line 43 via line 44 and passed to hydrotreater 45. If the mixture of sulfonic acid esters withdrawn from the tank is highly viscous, it may be advantageous to add an inert diluent oil to lower the viscosity and facilitate pumping. The inert diluent oil will normally be a saturated hydrocarbon or mixture of saturated hydrocarbons such as pentane, hexane, heptane, octane, isooctane or higher molecular weight hydrocarbon. An aromatic compound or mixture of aromatic compounds may, however, be used as the diluent oil if it is inert to the sulfonic acid esters and the hydrotreating process. If a diluent oil is needed, it may be mixed with the esters by injection into line 43 via line 46.

In the hydrotreater the hydrogen gas, sulfonic acid esters, and, if utilized, the diluent oil are passed downward through a fixed bed of standard hydrotreating catalyst under standard hydrotreating conditions. Both the hydrotreating catalyst and conditions are described in the literature and will therefore be familiar to those skilled in the art. The hydrogen reacts with the sulfonic acid esters in the presence of the hydrotreating catalyst to cleave both their carbon-sulfur bonds and their carbon-oxygen bonds and produce the sulfonic acid parent hydrocarbons, hydrogen sulfide, water, and the parent hydrocarbon of the alcohol used to produce the sulfonic acid esters in tank 40. These products and any other substances present in the hydrotreater effluent are withdrawn from the bottom of the hydrotreater through line 47, cooled and passed to separator or similar vessel 48.

In vessel 48 the gases in the hydrotreator effluent are allowed to separate from the water and oil and are withdrawn through line 49 and passed to scrubber or similar device 50. The gases will normally be composed primarily of hydrogen sulfide and unreacted hydrogen, but may also include the alcohol parent hydrocarbon if it is a gas at separator operating conditions. In scrubber 50 hydrogen is separated from the hydrogen sulfide and other gases by passing the mixture of gases upward through a downflowing scrubbing fluid injected into the top of the scrubber via line 51. The scrubbing fluid absorbs the hydrogen sulfide and is withdrawn from the bottom of the scrubber through line 52 and passed to downstream units for regeneration or further processing. Any solvent, including water, that will selectively absorb hydrogen sulfide in the presence of hydrogen may be employed as the scrubbing fluid. Such solvents are described in the literature and will be familiar to those skilled in the art. The hydrogen is removed from the scrubber through line 53 and recycled to the hydrotreater via lines 44 and 43.

The water in separator 48 will normally have a greater specific gravity than the oil phase and is removed via line 54 and passed to downstream units for further processing. The oil phase, consisting primarily of the sulfonic acid parent hydrocarbons, the alcohol parent hydrocarbon and, if utilized, a diluent oil, is withdrawn from the separator through line 55 and passed to fractionator 56 where the sulfonic acid parent hydrocarbons are separated from the alcohol parent hydrocarbon and, if present, the diluent oil. If a diluent oil is used, it should normally have a boiling point higher than that of the alcohol parent hydrocarbon and therefore will normally be removed from the fractionator as a sidestream through line 57 and recycled to the process via line 46. The overhead vapors, which will normally contain the lower boiling alcohol parent hydrocarbon, are withdrawn from the fractionator through line 58, cooled and passed to distillate drum 59 where the gases are taken off overhead through line 60 and passed to downstream units for further processing. The liquid, which will contain the alcohol parent hydrocarbon if it is not a gas, is withdrawn from distillate drum 59 through line 61. A portion of this liquid may be returned as reflux to the upper portion of the fractionator through line 62. The sulfonic acid parent hydrocarbons, which will normally have an initial boiling point higher than the boiling point of the alcohol parent hydrocarbon and the diluent oil, are removed in liquid form from the bottom of the fractionator through line 63 and recovered as a hydrocarbon oil product having a greater oxidation stability than process oils of comparable composition and viscosity.

The nature and objects of the invention are further illustrated by the results of laboratory tests. To test the hydrotreatability of ammonium sulfonates, a mixture of petroleum sulfonic acids derived from the production of white oil was neutralized with gaseous ammonia. The resultant ammonium sulfonates were mixed with 52 volume percent of SOLVESSO 150, an inert diluent oil composed of aromatic hydrocarbons. This mixture was then combined with hydrogen gas at a rate of 900 standard cubic feet per barrel and passed through a fixed bed of Nalco 471 cobalt-molybdenum catalyst at 550° F. and 650 psig. During the above-described hydrotreating process, $H_2S$ and $NH_3$ were evolved and a liquid product consisting of the diluent oil and the sulfonic acid parent hydrocarbons was produced. The diluent oil was boiled off leaving a hydrocarbon oil composed of the parent sulfonic acid hydrocarbons. This oil was analyzed and found to have the following properties:

| | |
|---|---|
| API Gravity | 22.6° |
| Viscosity (100° F.) | 159.33 centistokes |
| Viscosity (210° F.) | 11.25 centistokes |
| Pour Point | −5° F. |
| Aniline Point | 173.6° F. |
| Sulfur Content | .012 wt. % |
| Nitrogen Content | 11 ppm |
| Clay Gel Analysis | 34.88 wt. % saturates |
| | 63.90 wt. % aromatics |
| | 0.40 wt. % polars |
| Boiling Range | 501.7 – 1053.6° F. (2.5% – 92.5%) |
| (Gas chromatograph distillation) | 752.7 – 780.8° F. (10% – 90%) |

To test the oxidation stability of the recovered hydrocarbon oil, the oil was subjected to American Standard Test Method (ASTM) D 2112. A sample of the hydrocarbon oil was mixed with water and placed in a covered glass container along with a copper catalyst coil. The glass container was then placed in a copper bomb equipped with a pressure gauge. The bomb was charged with oxygen to a pressure of 90 psi and placed in an oil bath maintained at a constant temperature of 140° C. The bomb was then tilted to an angle of 30° from the horizontal and rotated axially at 100 rpm. The time for the oil to react with a given volume of oxygen, which was indicated by a specific drop in pressure, was measured. Another sample of the hydrocarbon oil was mixed with 0.4 weight percent of 2,6-di-tertiary-butyl-paracresol, an oxidation inhibitor, and subjected to the same test. The results of these tests are set forth below in Table I and compared to the reaction times obtained from similar tests conducted on process oils and process oil blends of comparable aromatics content and viscosities. The measured reaction times can be used to compare the oxidation stability of the various oils, which is normally an indicator of the oil's service life.

TABLE I

| Sample | ASTM D 2112 Test Results: Uninhibited Reaction Time (Min.) | Inhibited[1] Reaction Time (Min.) | Additive Response Factor[2] | Wt. % Aromatics | Viscosity 100° F. CS | 100° F. SSU | 210° F. CS | 210° F. SSU |
|---|---|---|---|---|---|---|---|---|
| Hydrocarbon oil recovered from hydrotreating | 85 | 350 | 4.12 | 63.9 | 159 | 738 | 11.2 | 63.7 |
| FLEXON 391[3] | 20 | 45 | 2.25 | 67 | | | 18 | 90 |
| FLEXON 340[4] | 30 | 60 | 2.0 | 70 | | | 3.6 | 38 |
| 55 Wt. % FLEXON 391/ 45 Wt. % FLEXON 340 | 30 | 56 | 1.87 | 68.4 | 134 | 623 | 7.9 | 52.2 |
| 74 Wt. % FLEXON 391/ 26 Wt. % FLEXON 340 | 32 | 55 | 1.72 | 67.8 | 285 | 1321 | 11.2 | 63.3 |

[1]Inhibited with 0.4 wt. % 2,6-di-tertiary-butyl-para-cresol
[2]Inhibited reaction time/ uninhibited reaction time
[3]A process oil derived from standard petroleum processing techniques
[4]A process oil derived from standard petroleum processing techniques It can be seen from Table I that the hydrocarbon oil produced during the hydrotreating of the ammonium sulfonates has much higher uninhibited and inhibited reaction times as well as a higher additive response factor than do the two FLEXON process oils, which have a similar aromatics content. Further, it can be seen that the uninhibited and inhibited reaction times and additive response factor of the hydrocarbon oil is much higher than those for the first listed oil blend, which has both an aromatics content and viscosity at 100° F. that is comparable to the hydrocarbon oil. The same is true for the second listed oil blend, which has both an aromatics content and viscosity at 210° F. similar to the hydrocarbon oil. The high uninhibited and inhibited reaction times and additive response factor of the hydrocarbon oil indicate that the oil has a superior oxidation stability and therefore will normally have a longer service life than the other oils of similar viscosity and composition listed in the Table.

It will be apparent from the preceding discussion that the invention provides a process for converting sulfonic acids into a hydrocarbon oil of superior oxidation stability. The oil can be used for many different purposes and exhibits a longer service life than other hydrocarbon oils of similar composition and viscosity.

We claim:

1. A process for converting a sulfonic acid or a mixture of sulfonic acids into a hydrocarbon oil of superior oxidation stability comprising:

(a) forming sulfonates by reacting said sulfonic acid or mixture of acids with a nitrogen-containing compound of the formula

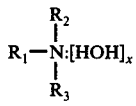

wherein $x$ is 0 or 1 and $R_1$, $R_2$, and $R_3$ are selected from the group consisting of hydrogen atoms, straight and branched chain aliphatic and substituted aliphatic radicals having from 1 to about 16 carbon atoms, cycloaliphatic radicals having from 3 to about 10 carbon atoms, and aryl radicals having from 6 to about 12 carbon atoms;

(b) reacting said sulfonates with hydrogen in the presence of a hydrotreating catalyst to cleave the carbon-sulfur bonds of said sulfonates; and (c) recovering a hydrocarbon oil of superior oxidation stability from the reaction products of step (b).

2. A process as defined in claim 1 wherein said mixture of acids comprises oil soluble petroleum sulfonic acids.

3. A process as defined in claim 1 including the additional step of mixing said sulfonates with an inert diluent oil before reacting said sulfonates with said hydrogen.

4. A process as defined in claim 1 wherein said nitrogen-containing compound comprises ammonia.

5. A process as defined in claim 1 wherein said nitrogen-containing compound comprises ammonium hydroxide.

6. A process as defined in claim 1 wherein said nitrogen-containing compound comprises methylamine.

7. A process as defined in claim 1 wherein said nitrogen-containing compound comprises dimethylamine.

8. A hydrocarbon oil of superior oxidation stability produced in accordance with the process of claim 1.

* * * * *